US010254023B2

(12) United States Patent
DelVentura

(10) Patent No.: US 10,254,023 B2
(45) Date of Patent: Apr. 9, 2019

(54) HEAT PIPE ANCHOR TUBES FOR HIGH SIDE HEAT EXCHANGERS

(71) Applicant: Heatcraft Refrigeration Products LLC, Stone Mountain, GA (US)

(72) Inventor: Robert DelVentura, Snellville, GA (US)

(73) Assignee: Heatcraft Refrigeration Products, LLC, Stone Mountain, GA (US)

( * ) Notice: Subject to any disclaimer, the term of this patent is extended or adjusted under 35 U.S.C. 154(b) by 101 days.

(21) Appl. No.: 15/428,328

(22) Filed: Feb. 9, 2017

(65) Prior Publication Data

US 2018/0224173 A1 Aug. 9, 2018

(51) Int. Cl.

| | |
|---|---|
| ***F25B 9/00*** | (2006.01) |
| ***F25B 39/00*** | (2006.01) |
| ***F28F 9/013*** | (2006.01) |
| ***F28D 15/02*** | (2006.01) |
| *F25B 39/04* | (2006.01) |

(52) U.S. Cl.

CPC ..... *F25B 39/00* (2013.01); *F25B 9/008* (2013.01); *F28D 15/02* (2013.01); *F28D 15/0275* (2013.01); *F28F 9/013* (2013.01); *F25B 39/04* (2013.01); *F25B 2339/042* (2013.01); *F25B 2500/32* (2013.01)

(58) Field of Classification Search

CPC .... F25B 2339/042; F25B 39/00; F25B 39/04; F28F 9/013

See application file for complete search history.

(56) References Cited

U.S. PATENT DOCUMENTS

| | | | | |
|---|---|---|---|---|
| 5,101,888 | A * | 4/1992 | Sprouse | C09K 5/04 165/104.13 |
| 8,468,845 | B2 * | 6/2013 | Chordia | F25B 9/008 62/260 |
| 2011/0226002 | A1 | 9/2011 | Dülger et al. | |
| 2017/0016201 | A1 * | 1/2017 | Wada | E02D 27/32 |

FOREIGN PATENT DOCUMENTS

| | | | |
|---|---|---|---|
| EP | 3 112 790 | 1/2017 | |
| JP | WO 2015129041 A1 * | 9/2015 | E02D 27/32 |

OTHER PUBLICATIONS

Communication from the European Patent Office re: Appl. No. 18155434.6-1008; Ref. JL93079P.EPP, dated Jun. 26, 2018.

* cited by examiner

*Primary Examiner* — Ana M Vazquez
(74) *Attorney, Agent, or Firm* — Baker Botts L.L.P.

(57) ABSTRACT

In a particular embodiment, a cooling system contains a compressor configured to compress a refrigerant, a high side heat exchanger configured to remove heat from the refrigerant, and a load configured to cool a space using the refrigerant. The high side heat exchanger has a frame and one or more refrigerant tubes extending through the frame, wherein each refrigerant tube has at least one cavity configured to allow the refrigerant to flow through the refrigerant tube. The high side heat exchanger is configured to remove heat from the refrigerant as the refrigerant flows through the one or more refrigerant tubes. The high side heat exchanger also has one or more heat pipes contacting the frame that, collectively, bear at least 25% of the weight of the one or more refrigerant tubes, are coupled directly to the frame, and are configured to remove heat from the flowing refrigerant.

17 Claims, 5 Drawing Sheets

HEAT PIPE ANCHOR TUBES FOR HIGH SIDE HEAT EXCHANGERS

TECHNICAL FIELD

This disclosure relates generally to cooling systems.

BACKGROUND

Typical cooling systems contain a compressor for compressing a refrigerant to a higher pressure, a high-side heat exchanger for removing heat from the refrigerant, and a load (e.g., an evaporator) for transferring heat from the load into the refrigerant, where the refrigerant is at a lower pressure. The refrigerant is then passed back to the compressor, and the process repeats as necessary.

Anchor tubes are used to physically suspend the high-side heat exchanger assemblies and components and to carry substantial amounts of the weight of the high-side heat exchanger (e.g., the coil), while refrigerant tubes carry the refrigerant throughout the heat exchanger. Without the anchor tubes, refrigerant tubes would bear substantial amounts of weight of the high-side heat exchanger assemblies or components, and the refrigerant tubes would risk leaking from the additional stress. Anchor tubes do not carry the refrigerant.

SUMMARY OF THE DISCLOSURE

In a particular embodiment, a cooling system contains a compressor configured to compress a refrigerant, a high side heat exchanger configured to remove heat from the refrigerant, and a load configured to cool a space using the refrigerant. The high side heat exchanger has a frame and one or more refrigerant tubes extending through the frame, wherein each refrigerant tube has at least one cavity configured to allow the refrigerant to flow through the refrigerant tube. The high side heat exchanger is configured to remove heat from the refrigerant as the refrigerant flows through the one or more refrigerant tubes. The high side heat exchanger also has one or more heat pipes contacting the frame that, collectively, bear at least 25% of the weight of the one or more refrigerant tubes, are coupled directly to the frame, and are configured to remove heat from the flowing refrigerant.

Certain embodiments may provide one or more technical advantages. For example, particular embodiments may provide enhanced heat rejection capability to high side heat exchangers, allowing refrigeration tubes to expel additional heat. Specifically, some embodiments use the volume occupied by current anchor tubes and instead use heat pipes, which may add additional heat removal capacity to high side heat exchangers of the same size. By replacing standard anchor tubes with heat pipes, some embodiments carry the weight of components of a high side heat exchanger, such as the coil, while also increasing the ability to transfer heat away from the refrigeration tubes. In particular embodiments, high side heat exchangers can maintain the same or similar physical space while increasing heat rejection efficiency and efficiency of the overall cooling system. Similarly, anchor pipes may be replaced by heat pipes of the same size and geometry in certain embodiments, thus allowing for simpler and easier implementation of embodiments of this disclosure without significant redesign of existing high side heat exchangers. In other embodiments, heat pipes may be used that are smaller, larger, or have different geometries than existing anchor pipes, providing design flexibility.

Some embodiments also use the frame as a heat sink connected to load-bearing heat pipes, which may further increase the efficiency of high side heat exchangers. By rejecting additional heat from the refrigerant, and/or by more efficiently rejecting heat from the refrigerant, certain embodiments may increase the ability (or efficiency) of a load to cool a space, such as a space proximate to the load.

Particular embodiments provide structural support (e.g., load bearing) and help prevent refrigerant tubes from leaking (for example, by bearing some or all of the weight of the coil and/or other components of high side heat exchanger), while also providing enhanced heat transfer capability. Certain embodiments may include none, some, or all of the above technical advantages. One or more other technical advantages may be readily apparent to one skilled in the art from the figures, descriptions, and claims included herein.

BRIEF DESCRIPTION OF THE DRAWINGS

For a more complete understanding of the present disclosure, reference is now made to the following description, taken in conjunction with the accompanying drawings, in which.

DETAILED DESCRIPTION

Typical cooling systems contain a compressor for compressing a refrigerant to a higher pressure, a high-side heat exchanger for removing heat from the refrigerant, and a load (e.g., an evaporator) for transferring heat from the load and/or area surrounding the load into the refrigerant (e.g., cooling the area proximate to the load using the refrigerant), where the refrigerant is at a lower pressure. The refrigerant is then passed back to the compressor, and the process repeats as necessary.

Anchor tubes are used to physically suspend the high-side heat exchanger assemblies and components and to carry substantial amounts of the weight of the high-side heat exchanger (e.g., the coil), while refrigerant tubes carry the refrigerant throughout the heat exchanger. Without the anchor tubes, refrigerant tubes would bear substantial amounts of weight of the high-side heat exchanger assemblies or components, and the refrigerant tubes would risk leaking from the additional stress. Anchor tubes do not carry the refrigerant. As a result, the anchor tubes do not enhance the heat removal capabilities of the high-side heat exchanger.

This disclosure contemplates a high-side heat exchanger that replaces anchor tubes with heat pipes. By using heat pipes in the role of anchor tubes, particular embodiments of this disclosure provide structural load-bearing support while also providing enhanced heat removal from the refrigerant. Certain embodiments therefore may provide, for example, increased efficiency using the same volume and/or dimensions of materials. By increasing the efficiency of high side heat exchangers, the overall efficiency of cooling systems may be improved as well. For example, by rejecting additional heat from the refrigerant, and/or by more efficiently rejecting heat from the refrigerant, certain embodiments may increase the ability (or efficiency) of a load to cool a space, such as a space proximate to the load. Certain embodiments may include none, some, or all of the above technical advantages described herein. One or more other technical advantages may also be readily apparent to one skilled in the art from the figures, descriptions, and claims included herein.

Figure 1:
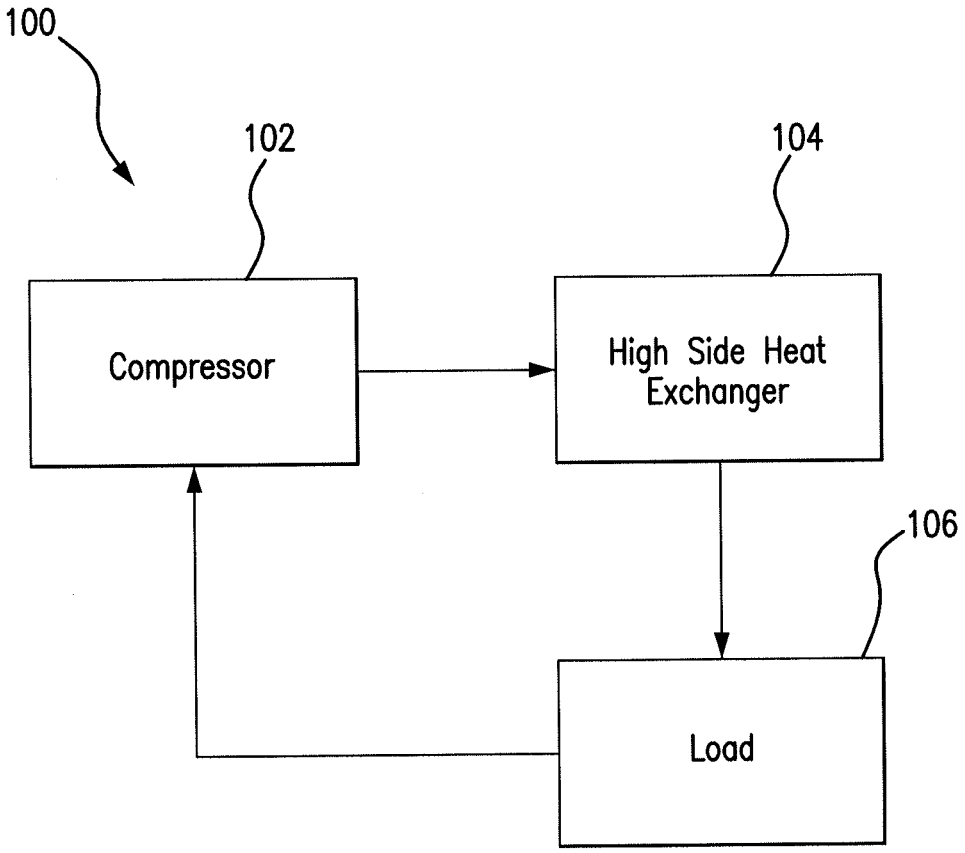
FIG. 1 illustrates an example generic cooling system, according to a particular embodiment.

FIG. 1 illustrates an example generic cooling system 100, according to a particular embodiment. Cooling system 100 contains a compressor 102, a high side heat exchanger 104, and a load 106.

Compressor 102 generally compresses a refrigerant to a higher pressure, in certain embodiments. A refrigerant is a substance, generally a gas or a liquid, that is used by cooling system 100 to absorb and/or release heat. In particular embodiments, a refrigerant is the working substance in cooling system 100 that flows through some or all of the components of cooling system 100, transferring heat from one location to another. Examples of refrigerants include air, water, ammonia, carbon dioxide ($CO_2$), chlorofluorocarbons, or any other suitable refrigerant.

High side heat exchanger 104 generally removes heat from the refrigerant, in particular embodiments. For example, high side heat exchanger 104 may be configured to remove heat from the refrigerant as the refrigerant flows through one or more refrigerant tubes in the high side heat exchanger 104. Examples of high side heat exchangers include condensers, $CO_2$ gas coolers, fluid coolers, etc. In some embodiments, the refrigerant in a high side heat exchanger is at a higher pressure (e.g., after being pressurized by compressor 102) than in other components of cooling system 100 (e.g., load 106).

Load 106 generally adds heat to the refrigerant (i.e. the refrigerant absorbs heat), thus cooling the load and/or the area around the load (proximate to the load), in some embodiments. Examples of loads include evaporators and heat exchangers (e.g. low side heat exchangers), or any other suitable load. In certain embodiments, an expansion valve or other apparatus is present between the high-side heat exchanger and the load that lowers the pressure of the refrigerant before the refrigerant enters the load. In such embodiments, the refrigerant tends to cool as its pressure is decreased, thus increasing the efficiency at which the refrigerant can absorb heat from the load.

Cooling system 100 may, in certain embodiments, be a closed-loop system that passes one or more refrigerants among the components of cooling system 100. For example, the refrigerant in the load eventually flows back to the compressor and is, e.g., re-pressurized to a higher pressure before being resent to the high side heat exchanger in some embodiments. Cooling system 100 is illustrated as a generic system, and may be modified or added to in any suitable way, as understood by a skilled practitioner.

Figure 2:
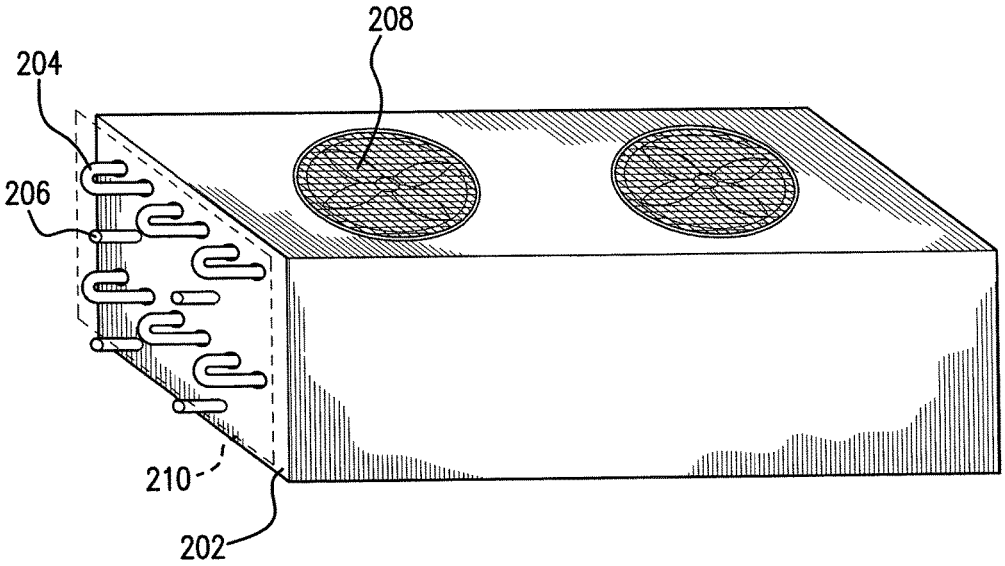
FIG. 2 illustrates an example high side heat exchanger, according to a particular embodiment.

FIG. 2 illustrates an example high side heat exchanger 200, according to a particular embodiment. High side heat exchanger 200 may operate, for example, like high side heat exchanger 104 in FIG. 1. As an example, high side heat exchanger 200 may operate to remove heat from a refrigerant, e.g., as the refrigerant flows through one or more refrigerant tubes 204. High side heat exchanger 200 comprises a frame 202, one or more refrigerant tube 204, one or more anchor tube 206, and one or more fans 208. Area 210 of high side heat exchanger 200 shows a coil of refrigerant tube 204 and anchor tubes 206.

Frame 202 generally encloses and/or supports the weight of high side heat exchanger 200. Frame 202 may be made of any suitable material such as metal, polymer, etc. In certain embodiments, frame 202 may enclose some or all of the components of high side heat exchanger 200, such as refrigerant tube 204, anchor tube 206, and fan 208.

Refrigerant tube 204 is a tube (a structure with one or more cavities) of any suitable shape that generally contains a refrigerant, such as the refrigerants described above with regard to FIG. 1, and allows the refrigerant to flow through the refrigerant tube. Refrigerant tube 204 may extend through the frame in some embodiments. Refrigerant tube 204 may be made of any suitable material, such as metal (e.g., copper, steel, etc.). In certain embodiments, refrigerant tube 204 contains refrigerant that was sent from another component (e.g., compressor 102). In certain embodiments, refrigerant tube 204 contains refrigerant that will be sent to another component (e.g., load 106). The refrigerant in refrigerant tube 204 may release heat into substances comprising or surrounding high side heat exchanger 200. For example, the refrigerant in refrigerant tube 204 may give off heat into air that passes through high side heat exchanger 200. In particular embodiments, refrigerant tube 204 may be formed into a coil, or any other suitable formation, which may serve to increase the length and/or surface area of refrigerant tube 204 (and thus increase the ability of refrigerant tube 204 to give off heat in high side heat exchanger 200). Refrigerant tube 204 may not touch frame 202 in certain embodiments. Refrigerant tube 204 may, in some embodiments, not bear any weight of high side heat exchanger 200 (or any components thereof), bear only its own weight, or bear less than, directly or indirectly, 5%, 10%, 20%, 25%, 40%, 50%, or any other suitable percentage of high side heat exchanger 200 or components thereof.

Anchor tube 206 is a tube that generally bears the weight of high side heat exchanger 200 or components thereof. Anchor tube 206 may extend through and/or contact the frame in some embodiments. Anchor tube 204 may be made of any suitable material, such as metal (e.g., copper, steel) and may be any suitable shape. For example, anchor tubes 206 may be hollow tubes (as shown in FIG. 2). In particular embodiments, anchor tube 206 bears some or all of the weight of a coil of refrigerant tube(s) 204. In particular embodiments, anchor tube 206 bears some or all of the weight of high side heat exchanger 200 assembly or components thereof. Anchor tube 204 may, in some embodiments, touch frame 202 and be directly coupled to frame 202. For example, anchor tube 204 may be mechanically expanded to contact frame 202 while supporting some or all of refrigerant tube 204 (e.g., in a coil configuration). In such an example, the weight of the coil of refrigerant tube 204 is carried to frame 202 (via anchor tubes 206), and frame 202 carries the weight (of these and possibly other components) to the ground or any other mounting point on high side heat exchanger 200 (e.g., feet, bolts, etc.). Anchor tube 206 may bear, directly or indirectly, 5%, 10%, 20%, 25%, 40%, 50%, 100% or any other suitable percentage (e.g., at least 75%) of refrigerant tube 204, according to some embodiments. Anchor tube 206 may bear, directly or indirectly, 5%, 10%, 20%, 25%, 40%, 50%, 100% or any other suitable percentage (e.g., at least 75%) of high side heat exchanger 200 or components thereof, according to some embodiments Fan 208 generally creates an air flow that flows around refrigerant tubes 204. In certain embodiments, fan 208 is located in or around high side heat exchanger 200 to create an airflow. The airflow, in example embodiments, contacts refrigerant tubes 204, which expel heat into the airflow caused by fan 208. Thus, in certain embodiments, fan 208 allows the refrigerant in refrigerant tube 204 to more efficiently give off heat.

While high side heat exchanger 200 is illustrated as containing certain components, it may be modified or added to in any suitable way, as understood by a skilled practitioner.

Figure 3:
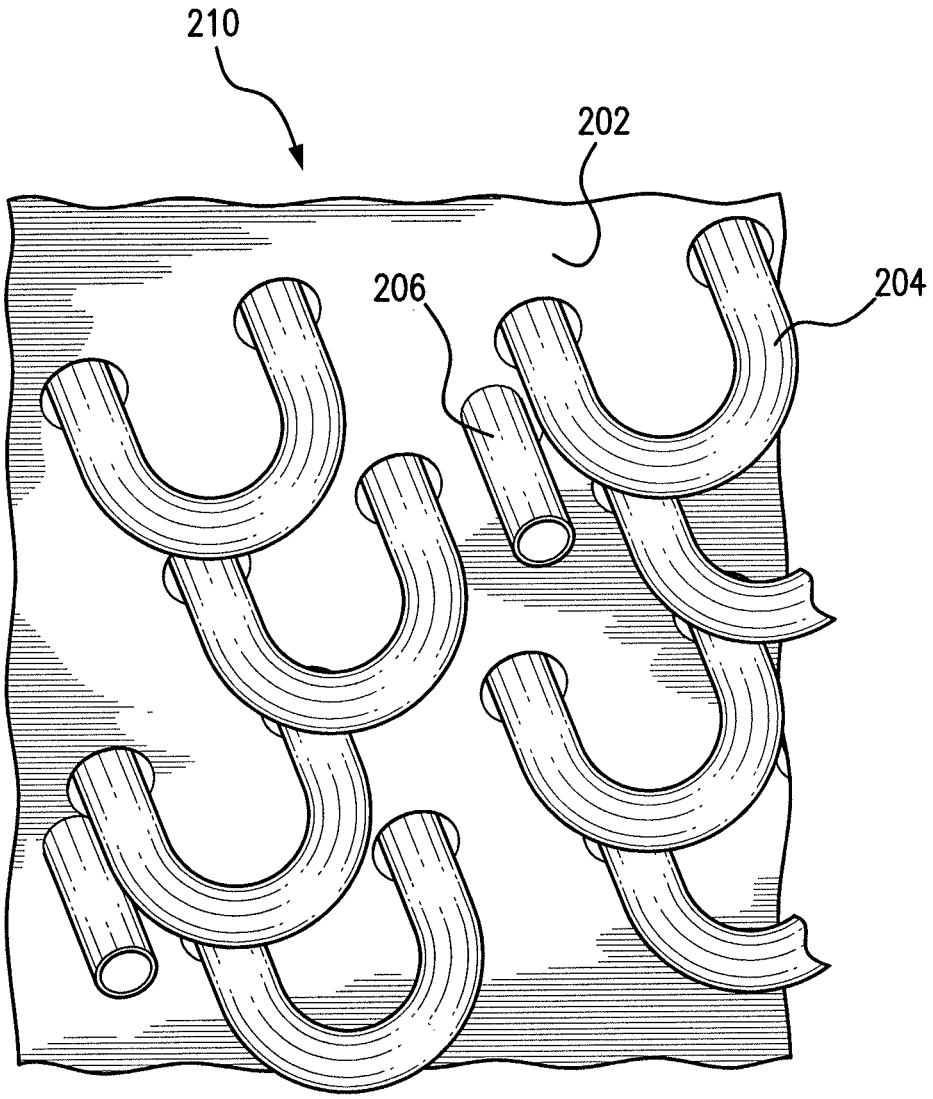
FIG. 3 illustrates a close up view of an area of the high side heat exchanger of FIG. 2, according to a particular embodiment.

FIG. 3 illustrates a close up view of area 210 of the high side heat exchanger 200 of FIG. 2, according to a particular embodiment. Area 210 contains frame 202, refrigerant tube 204, and anchor tubes 206 as illustrated in FIG. 2. The example shown in FIG. 3 shows that refrigerant tube 204 (which may be one or more refrigerant tubes, e.g., in a coil configuration) does not directly contact or bear its weight on frame 202 of high side heat exchanger 200. This example also shows that anchor tubes 206 (which may be one or more anchor tubes) do directly contact and bear some of all of their weight on frame 202. As shown in this example, anchor tubes 206 may be hollow tubes with their internal cavities exposed.

Figure 4:
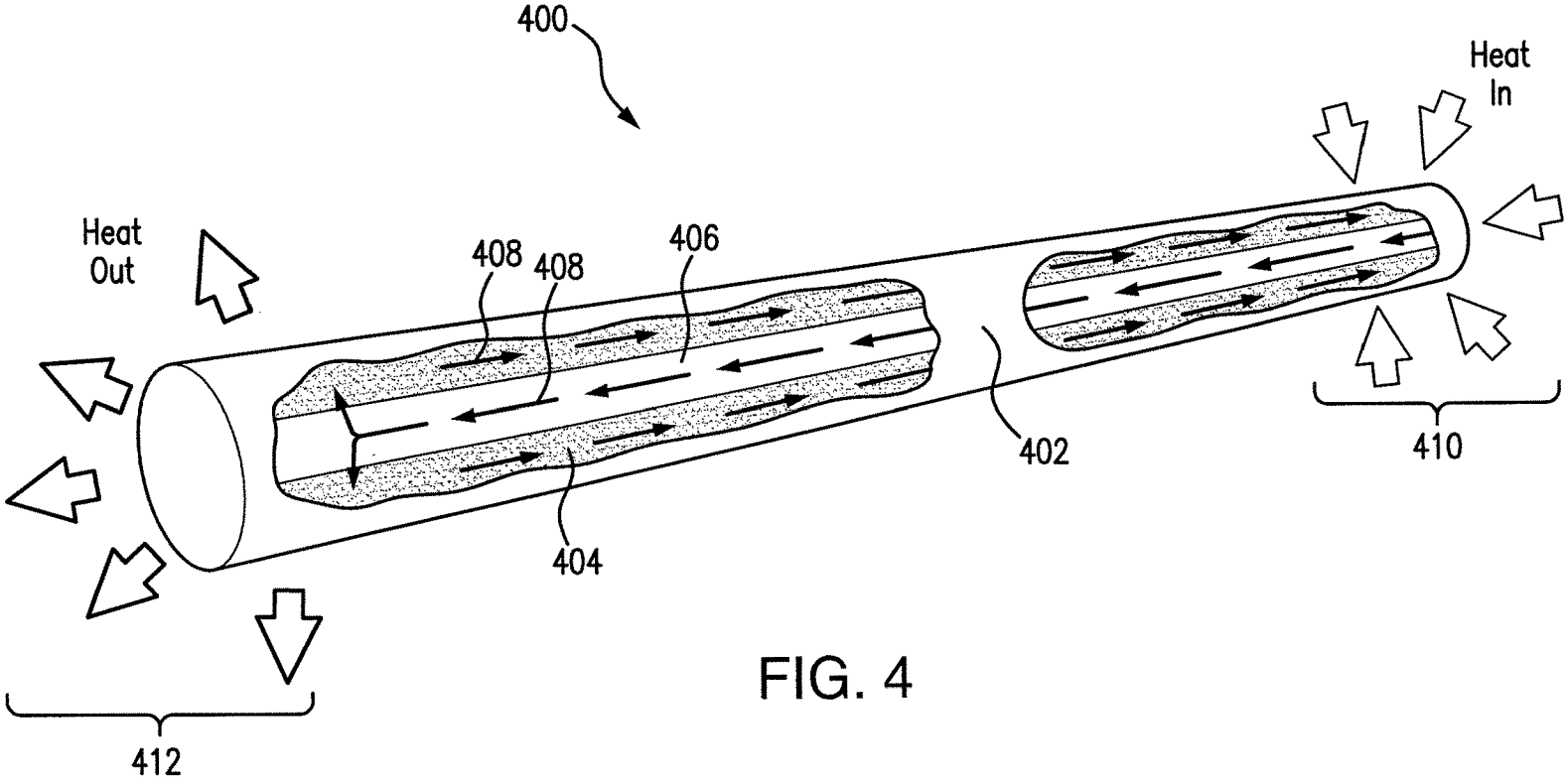
FIG. 4 illustrates a generic heat pipe, according to a particular embodiment.

FIG. 4 illustrates a generic heat pipe 400, according to a particular embodiment. In general, heat pipes, such as heat pipe 400, cause heat to flow from an area of high heat to an area of low heat using one or more working fluids. For example, heat pipe 400 may be configured to transfer heat from a first end of the heat pipe to a second end of the heat pipe. Heat pipes are, in certain embodiments, more efficient at transferring heat than solid metals, air alone, etc. In some embodiments, Heat pipe 400 transfers heat from end 410 having a higher ambient temperature to end 412 having a lower ambient temperature. Heat pipe 400 comprises a container 402 surrounding a wick 404 and a vapor space 406, and a working fluid 408.

In an example embodiment, heat pipe 400 (encased in container 402) may operate such that end 410 acts as an evaporator and end 412 acts as a condenser. In this example, working fluid 408 absorbs heat at end 410 such that it evaporates from liquid (residing in wick 404 near end 410) to vapor. This vapor travels along vapor space 406 toward end 412. As the working fluid 408 (in vapor form) nears end 412, it gives off heat and cools, condensing from vapor to liquid. This liquid travels along wick 404 (e.g., using capillary pressure) back toward end 410. In certain embodiments, this process repeats itself, thus continually transferring heat from an area of higher ambient temperature (around end 410) to an area of lower ambient temperature (around end 412).

Container 402 is a solid material, in some embodiments, that holds the components of heat pipe 400 together and contains working fluid 408. In certain embodiments, container 402 may be copper, steel, or another metal that is sealed around wick 404, vapor space 406, and working fluid 408. Container 402 may aid in the transfer of heat within heat pipe 400. Container 402 may be made of any suitable material, with any suitable ability to transfer heat, in any suitable shape (e.g., a round tube, a tube with a rectangular cross section, etc.).

Wick 404 is a material that, in certain embodiments, serves to absorb working fluid 408 in liquid form and pump it, via capillary pressure for example, from an area of higher concentration of liquid working fluid 408 to an area of lower concentration of liquid working fluid 408. An example of this is described above. Wick 404 may be made of any suitable material, such as metal fabrics or fibers, powders, cloth fabrics or fibers, etc.

Vapor space 406 is a space for working fluid 408 (in vapor form) to travel from one end of heat pipe 400 to another, in certain embodiments. Vapor space 406 may be in any suitable form or contain any suitable material. For example, vapor space 406 may contain a void or a capillary structure that allows vaporized working fluid 408 to travel along heat pipe 400. Vapor space 406, in certain embodiments, may be at or near the center of heat pipe 400, such that wick 404 is between heat vapor space 406 and container 402, though any suitable configuration of the components of heat pipe 400 is contemplated.

Working fluid 408 is any suitable fluid that, when implemented in heat pipe 400, assists with transferring heat from one area of heat pipe 400 to another. In certain embodiments, working fluid 408 undergoes a phase change from liquid to gas (and back again) under the operating conditions (e.g., temperature, pressure, etc.) in which heat pipe 400 operates. Examples of working fluid 408 include acetone, ammonia, methanol, water, carbon dioxide, sodium, or any other suitable working fluid. In certain embodiments, working fluid may or may not be under pressure or under vacuum.

While heat pipe 400 is illustrated as containing certain components, it may be modified or added to in any suitable way, as understood by a skilled practitioner.

Figure 5:
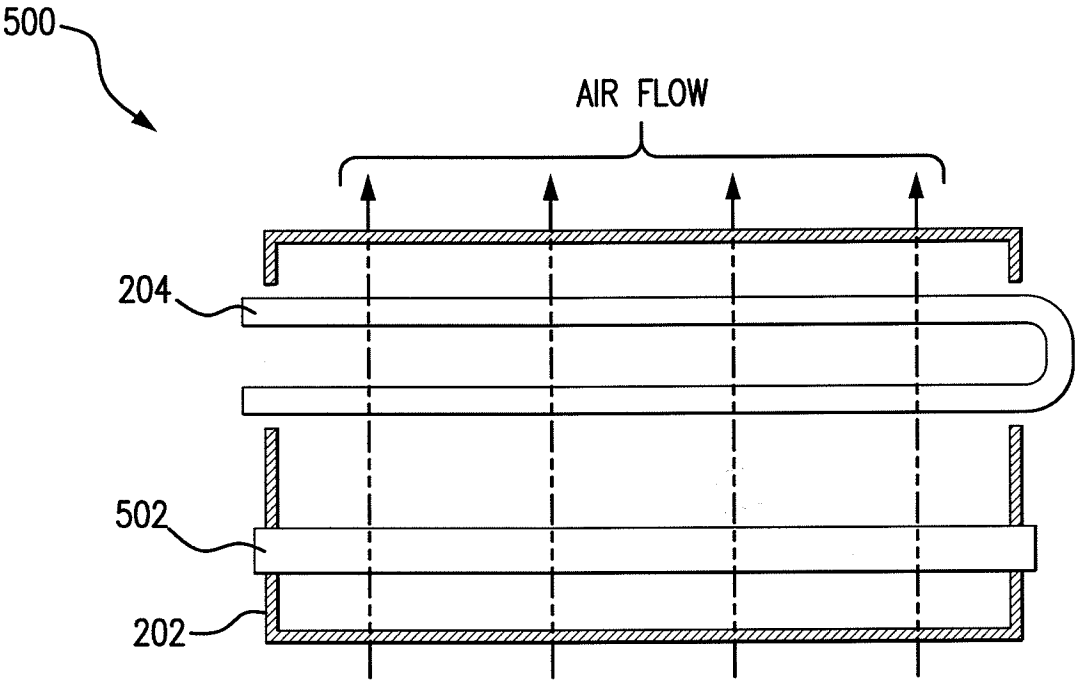
FIG. 5 represents a cross section of a portion of an example high side heat exchanger containing a heat pipe that also acts as an anchor tube.

FIG. 5 represents a cross section of a portion of an example high side heat exchanger 500 containing a heat pipe 502 that also acts as an anchor tube. The high side heat exchanger 500 represented in FIG. 5 may, in some embodiments, be the same as the high side heat exchanger 200 represented in FIG. 2, except high side heat exchanger 500 uses one or more heat pipes 502 (such as heat pipe 400 described in FIG. 4) as anchor pipes (e.g., anchor pipes 206). High side heat exchanger 500 contains a frame 202, a refrigerant tube 204, and a heat pipe 502.

High side heat exchanger 500 contains a frame 202, which in some embodiments may be the same or similar to frame 202 as discussed with regard to FIG. 2.

High side heat exchanger 500 also contains one or more refrigerant tube 204, which in some embodiments may be the same as or similar to refrigerant tube 204 as discussed with regard to FIG. 2. In certain embodiments, refrigerant tube 204 does not make direct contact with frame 202 (or, e.g., with other components of high side heat exchanger 500) or carry any weight (i.e. bear any physical load) of high side heat exchanger 500. In other embodiments, refrigerant tube 204 may contact frame 202 and/or carry any suitable load of high side heat exchanger 500.

High side heat exchanger 500 contains heat pipe 502. An example of heat pipe 502 is heat pipe 400 as described in FIG. 4, though any suitable heat pipe may be used. In particular embodiments, heat pipe 502 may be used instead of, or in conjunction with, anchor tubes (e.g., anchor tubes 206). In such embodiments, heat pipe 502 may perform the role similarly performed by anchor tubes 206. For example, heat pipe 502 may carry some or all of the weight (bear the load) of refrigerant tube 204 (e.g., a coil of one or more refrigerant tube in high side heat exchanger 500). As another example, heat pipe 502 may carry some or all of the weight (bear the load) of high side heat exchanger 500, or any component thereof. In certain embodiments, heat pipe 502 may be press-fitted into contact with frame 202.

Additionally, in some embodiments, heat pipe 502 may physically contact portions of frame 202, which may act as a heat sink for heat pipe 502, thus further increasing the ability of heat pipe 502 to transfer and dissipate heat. For example, heat pipe 502 is coupled directly to the frame in some embodiments. Heat pipe 502 may, in some embodiments, act to cool refrigerant tube 204, including the refrigerant within, in any number of suitable ways. For example, heat pipe 502 is configured to remove heat from the refrigerant as the refrigerant flows through the one or more refrigerant tubes 204, in some embodiments. As another example, heat pipe 502 may contact refrigerant tube 204 and dissipate its heat to the surrounding air (e.g., an air flow in high side heat exchanger 500) or to frame 202, which may be used as a heat sink. As another example, heat pipe 502 may absorb heat from the area surrounding refrigerant tube 204 (e.g., from warm air around refrigerant tube 204) and dissipate that heat to cooler air, air further away from refrigerant tube 204, and/or frame 202. As a further example, refrigerant tube 204 may contact (or otherwise heat) one or more heat dissipating fins (e.g., made of metal, such as aluminum) in high side heat exchanger 500, and heat pipe 502 may contact (or otherwise remove heat from) such fins and transfer the heat to cooler air, air further away from refrigerant tube 204, and/or frame 202. Heat pipe 502 may support some or all of the weight of refrigerant tube 204 by contacting or bonding to one or more fins, in certain embodiments. In certain embodiments, heat dissipating fins may be added to heat pipe 502 at any suitable location, additional heat sinks may be added (e.g. to the frame, heat pipe 502, etc.), and/or mechanical sub-cooling systems may be used in conjunction with heat pipe 502, any or all of which may increase the ability of heat pipe 502 to dissipate heat. Any suitable configuration that allows heat pipe 502 to bear some or all of the weight of high side heat exchanger 500 (or any components within) and/or transfer heat from the refrigerant within refrigerant tube 204 to another material is contemplated.

Modifications, additions, or omissions may be made to the systems, apparatuses, and methods described herein without departing from the scope of the disclosure. The components of the systems and apparatuses may be integrated or separated. Moreover, the operations of the systems and apparatuses may be performed by more, fewer, or other components. For example, an expansion valve or tank may be added to the cooling system of FIG. 1 to decrease the pressure of the refrigerant between high side heat exchanger 104 and load 106. One skilled in the art will also understand that replacing anchor tubes with heat pipes may be used with any suitable heat exchanger in any suitable type of cooling system. As used in this document, "each" refers to each member of a set or each member of a subset of a set.

Modifications, additions, or omissions may be made to the methods described herein without departing from the scope of the disclosure. The methods may include more, fewer, or other steps. Additionally, steps may be performed in any suitable order.

Although this disclosure has been described in terms of certain embodiments, alterations and permutations of the embodiments will be apparent to those skilled in the art. Accordingly, the above description of the embodiments does not constrain this disclosure. Other changes, substitutions, and alterations are possible without departing from the spirit and scope of this disclosure.

The invention claimed is:

1. A cooling system, comprising:
- a compressor configured to compress a refrigerant;
- a high side heat exchanger configured to remove heat from the refrigerant from the compressor, the high side heat exchanger comprising:
  - a frame;
  - one or more refrigerant tubes extending through the frame, wherein:
    - each refrigerant tube of the one or more refrigerant tubes comprises at least one cavity configured to allow the refrigerant to flow through the refrigerant tube; and
    - the high side heat exchanger is configured to remove heat from the refrigerant as the refrigerant flows through the one or more refrigerant tubes; one or more heat pipes contacting the frame, wherein:
    - the one or more heat pipes, collectively, bear at least 25% of a weight of the one or more refrigerant tubes;
    - each heat pipe of the one or more heat pipes is coupled directly to the frame; and
    - each heat pipe of the one or more heat pipes is configured to transfer heat from a refrigerant tube of the one or more refrigerant tubes to the frame as the refrigerant flows through the one or more refrigerant tubes; and
- a load configured to use the refrigerant from the high side heat exchanger to cool a space proximate the load.

2. The cooling system of claim 1, wherein each heat pipe of the one or more heat pipes comprises:
- a container;
- a wick disposed within the container; and
- a working fluid disposed within the container, the working fluid configured to transfer heat from a first end of the heat pipe to a second end of the heat pipe.

3. The cooling system of claim 1, wherein the one or more heat pipes, collectively, bear at least 75% of the weight of the one or more refrigerant tubes.

4. The cooling system of claim 1, wherein the refrigerant is carbon dioxide.

5. The cooling system of claim 1, wherein the high side heat exchanger is one of a gas cooler and a fluid cooler.

6. The cooling system of claim 1, wherein the high side heat exchanger is a condenser.

7. A high side heat exchanger, comprising:
- a frame;
- one or more refrigerant tubes extending through the frame, wherein:
  - each refrigerant tube of the one or more refrigerant tubes comprises at least one cavity configured to allow a refrigerant to flow through the refrigerant tube; and
  - the high side heat exchanger is configured to remove heat from the refrigerant as the refrigerant flows through the one or more refrigerant tubes;
- one or more heat pipes contacting the frame, wherein:
  - the one or more heat pipes, collectively, bear at least 25% of a weight of the one or more refrigerant tubes;
  - each heat pipe of the one or more heat pipes is coupled directly to the frame; and
  - each heat pipe of the one or more heat pipes is configured to transfer heat from a refrigerant tube of the one or more refrigerant tubes to the frame as the refrigerant flows through the one or more refrigerant tubes.

8. The high side heat exchanger of claim 7, wherein each heat pipe of the one or more heat pipes comprises:
- a container;
- a wick disposed within the container; and
- a working fluid disposed within the container, the working fluid configured to transfer heat from a first end of the heat pipe to a second end of the heat pipe.

9. The high side heat exchanger of claim 7, wherein the one or more heat pipes, collectively, bear at least 75% of the weight of the one or more refrigerant tubes.

10. The high side heat exchanger of claim 7, wherein the refrigerant is carbon dioxide.

11. The high side heat exchanger of claim 7, wherein the high side heat exchanger is one of a gas cooler and a fluid cooler.

12. The high side heat exchanger of claim 7, wherein the high side heat exchanger is a condenser.

13. A method comprising:

passing a refrigerant through one or more refrigerant tubes extending through a frame of a high side heat exchanger, each refrigerant tube of the one or more refrigerant tubes comprises at least one cavity configured to allow the refrigerant to flow through the refrigerant tube;

removing heat from the refrigerant as the refrigerant flows through the one or more refrigerant tubes;

bearing, by one or more heat pipes, at least 25% of a weight of the one or more refrigerant tubes, each heat pipe of the one or more heat pipes is coupled directly to the frame; and transferring, by the one or more heat pipes, heat from the refrigerant as the refrigerant flows through the one or more refrigerant tubes to the frame.

14. The method of claim 13, further comprising transferring, by a working fluid disposed within a container of the heat pipe, heat from a first end of the heat pipe to a second end of the heat pipe.

15. The method of claim 13, further comprising bearing, by the one or more heat pipes, at least 75% of the weight of the one or more refrigerant tubes.

16. The method of claim 13, wherein the refrigerant is carbon dioxide.

17. The method of claim 13, wherein the high side heat exchanger is one of a gas cooler, a fluid cooler, and a condenser.

* * * * *